US009865929B2

(12) United States Patent
Wong et al.

(10) Patent No.: US 9,865,929 B2
(45) Date of Patent: Jan. 9, 2018

(54) COMMUNICATION DEVICE AND ANTENNA ELEMENT THEREIN

(71) Applicant: Acer Incorporated, New Taipei (TW)

(72) Inventors: Kin-Lu Wong, New Taipei (TW); Hung-Jen Hsu, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 229 days.

(21) Appl. No.: 14/012,314

(22) Filed: Aug. 28, 2013

(65) Prior Publication Data

US 2015/0002363 A1 Jan. 1, 2015

(30) Foreign Application Priority Data

Jun. 26, 2013 (TW) ..... 102122644 A

(51) Int. Cl.
*H01Q 5/50* (2015.01)
*H01Q 9/42* (2006.01)

(52) U.S. Cl.
CPC ..... *H01Q 9/42* (2013.01); *H01Q 5/50* (2015.01)

(58) Field of Classification Search
CPC ..... H01Q 21/28; H01Q 1/243; H01Q 5/385; H01Q 9/30; H01Q 9/0407
USPC ..... 343/866, 893
See application file for complete search history.

(56) References Cited

U.S. PATENT DOCUMENTS 4,584,709 A * 4/1986 Kneisel et al. ..... 455/78
6,787,703 B2 9/2004 Niinobe et al.
7,084,831 B2 8/2006 Takagi et al.
7,990,319 B2 8/2011 Boyle
8,872,712 B2 * 10/2014 Lee ..... 343/729
8,933,852 B2 1/2015 Wong et al.
(Continued)

FOREIGN PATENT DOCUMENTS

CN 1423386 6/2003
CN 1661855 8/2005
(Continued)

OTHER PUBLICATIONS

Chinese language office action dated Jul. 27, 2016, issued in application No. CN 201310286478.0.
(Continued)

*Primary Examiner* — Graham Smith
*Assistant Examiner* — Noel Maldonado
(74) *Attorney, Agent, or Firm* — McClure, Qualey & Rodack, LLP

(57) ABSTRACT

A communication device includes a ground element and an antenna element. The antenna element is disposed adjacent to an edge of the ground element. The antenna element includes a first metal element and a second metal element. The first metal element has a first end and a second end. The first end is coupled through a capacitive element to a communication module. The second end is coupled through a shorting element to the ground element. The second metal element has a third end and a fourth end. The third end is coupled to the communication module. The fourth end is open. The first metal element and the second metal element are adjacent to each other, but not connected to each other. The first metal element and the second metal element have projections on the edge of the ground element, wherein the projections do not overlap with each other.

9 Claims, 5 Drawing Sheets

(56) References Cited

U.S. PATENT DOCUMENTS

| | | | | |
|---|---|---|---|---|
| 2009/0009401 | A1 | 1/2009 | Suzuki et al. | |
| 2010/0013721 | A1 | 1/2010 | Kojima | |
| 2013/0057446 | A1 | 3/2013 | Hirobe et al. | |
| 2013/0241796 | A1 | 9/2013 | Nagumo | |
| 2013/0257674 | A1* | 10/2013 | Li | H01Q 5/321 343/853 |

FOREIGN PATENT DOCUMENTS

| | | |
|---|---|---|
| CN | 1697254 | 11/2005 |
| CN | 101167215 | 4/2008 |
| CN | 101578735 | 11/2009 |
| CN | 102044748 | 5/2011 |
| CN | 102739823 | 10/2012 |
| TW | I255588 B | 5/2006 |
| WO | WO 2012/066838 | 5/2012 |

OTHER PUBLICATIONS

Wong, et al.: Quarter-Wavelength Printed Loop Antenna for GSM/DCS/PCS/UMTS Operation; 978-1-4244-2642-3/08/$25.00 © 2008 IEEE; pp. 1-4.

TW Office Action dated Oct. 7, 2015 in corresponding Taiwain application (No. 102122644).

* cited by examiner

COMMUNICATION DEVICE AND ANTENNA ELEMENT THEREIN

CROSS REFERENCE TO RELATED APPLICATIONS

This Application claims priority of Taiwan Patent Application No. 102122644 filed on Jun. 26, 2013, the entirety of which is incorporated by reference herein.

BACKGROUND OF THE INVENTION

Field of the Invention

The disclosure generally relates to a communication device, and more particularly, relates to a tablet communication device and a low-profile antenna element therein.

Description of the Related Art

With fast development in wireless communication technology nowadays, mobile communication devices have more and more functions. To follow the current market trend and to satisfy user requirements, the design of mobile communication devices should be thin and light, and have better functions for data processing and audio visual entertainment. Since the size of the mobile communication device display has become larger but the frame space thereof has become smaller, there is limited design space for accommodating antenna elements. Accordingly, it is a critical challenge for antenna designers to design a low-profile multi-band antenna element in a small space in a mobile communication device.

BRIEF SUMMARY OF THE INVENTION

To solve the problems in the prior art, the invention provides a communication device comprising an antenna element. The antenna element comprises two separate metal elements for covering multiple bands. The antenna element at least has a plurality of advantages of simple structure, easy manufacturing, and low profile. The antenna element is suitably applied to a tablet computer, or in particular, to a thin tablet computer with narrow frame space. In some embodiments, the antenna element has a height of about 7 mm, and is capable of covering WWAN/LTE (Wireless Wide Area Network/Long Term Evolution) multiple bands (e.g., covering the WWAN/LTE bands from approximately 824 MHz to 960 MHz and from 1710 MHz to 2690 MHz).

In a preferred embodiment, the invention is directed to a communication device, comprising: a ground element; and an antenna element, disposed adjacent to an edge of the ground element, wherein the antenna element comprises: a first metal element, having a first end and a second end, wherein the first end is coupled through a capacitive element to a communication module, and the second end is coupled through a shorting element to the ground element; and a second metal element, having a third end and a fourth end, wherein the third end is coupled to the communication module, and the fourth end is open, wherein the first metal element and the second metal element are adjacent to each other, but are not connected to each other, and the first metal element has a first projection on the edge of the ground element, the second metal element has a second projection on the edge of the ground element, and the first projection and the second projection do not overlap with each other.

In some embodiments, the first end and the third end are away from each other, and the second end and the fourth end are between the first end and the third end. In some embodiments, a first matching circuit is further coupled between the capacitive element and the communication module. In some embodiments, a second matching circuit is further coupled between the third end and the communication module. In some embodiments, the first metal element is excited to generate a first band, the second metal element is excited to generate a second band, and frequencies of the second band are higher than frequencies of the first band. In some embodiments, the first band is approximately from 824 MHz to 960 MHz, and the second band is approximately from 1710 MHz to 2690 MHz. In some embodiments, the first metal element substantially extends parallel to the edge of the ground element. In some embodiments, the first metal element substantially has a straight-line shape. In some embodiments, the second metal element substantially has an inverted U-shape. In some embodiments, a length of the shorting element is greater than a distance between the first metal element and the edge of the ground element.

In some embodiments, the antenna element comprises two metal elements having different feeding points, and the metal elements are configured to control a low band and a high band, respectively. This design simplifies the structure of the antenna element and allows for low-profile characteristics. In addition, the second end of the first metal element controlling the low band is coupled to the ground element, and thus a loop-like structure is substantially formed by the first metal element and the edge of the ground element. The loop-like structure effectively reduces the mutual coupling between the first metal element and the ground element, thereby decreasing the height of the antenna element. For the second metal element, it controls the high band which has a much smaller wavelength than the low band, and hence it can achieve the desired wide operating band with a low antenna height. Accordingly, the invention effectively decreases the total height of the antenna element and achieves a low-profile antenna element design.

Note that in some embodiments, the resonant length of the first metal element is effectively decreased by incorporating the capacitive element into the first metal element, and the total size of the antenna element is thus reduced. In comparison to a conventional design, in which the size of an antenna element is reduced by incorporating an inductive element having a high inductance, the antenna element of the invention does not suffer from high efficiency loss due to the high series resistance with the inductive element having the high inductance, and thus solves the problem of the degradation of the antenna efficiency in the conventional design. In addition, the first matching circuit may be further incorporated into the antenna element to improve the impedance matching in the low band, and thus the antenna element can cover wider bands.

In some embodiments, the antenna element only has a length of about 60 mm and a height of about 7 mm. In this case, the antenna element is capable of covering the GSM850/900 operation in the low band and the GSM1800/1900/UMTS/LTE2300/2500 operation in the high band. In other words, the low-profile antenna element of the invention can cover at least the WWAN/LTE multiple bands.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures thereof in the invention are described in detail as follows.

Figure 1:
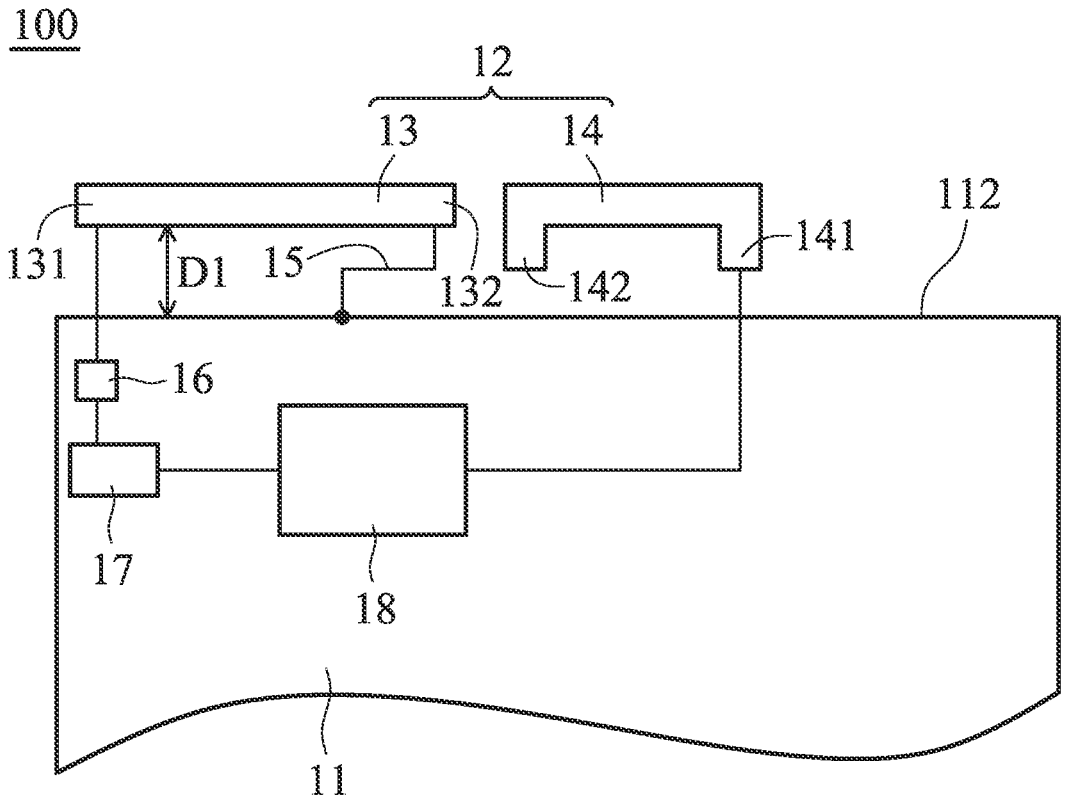
FIG. 1 is a diagram for illustrating a communication device according to a first embodiment of the invention.

FIG. 1 is a diagram for illustrating a communication device 100 according to a first embodiment of the invention. The communication device 100 may be a smartphone, a tablet computer, or a notebook computer. The communication device 100 at least comprises a ground element 11 and an antenna element 12. The ground element 11 may be a metal plane which is disposed on a dielectric substrate (not shown), such as an FR4 (Flame Retardant 4) substrate. The antenna element 12 is disposed adjacent to an edge 112 of the ground element 11. The antenna element 12 comprises a first metal element 13 and a second metal element 14. The first metal element 13 substantially extends parallel to the edge 112 of the ground element 11. In some embodiments, the first metal element 13 substantially has a straight-line shape, and the second metal element 14 substantially has an inverted U-shape. In other embodiments, any of the first metal element 13 and the second metal element 14 may have other shapes, such as an L-shape, a C-shape, a straight-line shape, a U-shape, an S-shape, or an irregular shape. The first metal element 13 and the second metal element 14 are adjacent to each other, but are not connected to each other. More particularly, the first metal element 13 overlies a first area of the edge 112 of the ground element 11, and the second metal element 14 overlies a second area of the edge 112 of the ground element 11, wherein the first area and the second area do not overlap with each other. The first metal element 13 has a first end 131 and a second end 132. The second metal element 14 has a third end 141 and a fourth end 142. The first end 131 and the third end 141 are away from each other, and the second end 132 and the fourth end 142 are between the first end 131 and the third end 141. In some embodiments, the communication device 100 further comprises a shorting element 15, a capacitive element 16, a first matching circuit 17, and a communication module 18. The first end 131 of the first metal element 13 is coupled through the capacitive element 16 and the first matching circuit 17 to the communication module 18. Note that the first matching circuit 17 is optional and it may be omitted in other embodiments. The second end 132 of the first metal element 13 is coupled through the shorting element 15 to the ground element 11. The third end 141 of the second metal element 14 is coupled to the communication module 18. The fourth end 142 of the second metal element 14 is open. The shorting element 15 may comprise a meandering metal structure. For example, the meandering metal structure may substantially have an N-shape or an S-shape. In some embodiments, the length of the shorting element 15 is greater than a distance D1 between the first metal element 13 and the edge 112 of the ground element 11. The capacitive element 16 may be a chip capacitor or a distributed capacitor. The first matching circuit 17 provides a first impedance value. In some embodiments, the first matching circuit 17 comprises one or more inductors and capacitors, such as chip inductors and chip capacitors. The capacitive element 16 and the first matching circuit 17 are both used to decrease the resonant length of the first metal element 13, thereby reducing the total size of the antenna element 12. The communication module 18 is considered as a signal source of the antenna element 12, and the signal source is used to excite the first metal element 13 and the second metal element 14 of the antenna element 12 to generate a low band and a high band, respectively. Note that the communication device 100 may further comprise other components, such as a touch panel, a processor, a speaker, a battery, and a housing (not shown).

Figure 2:
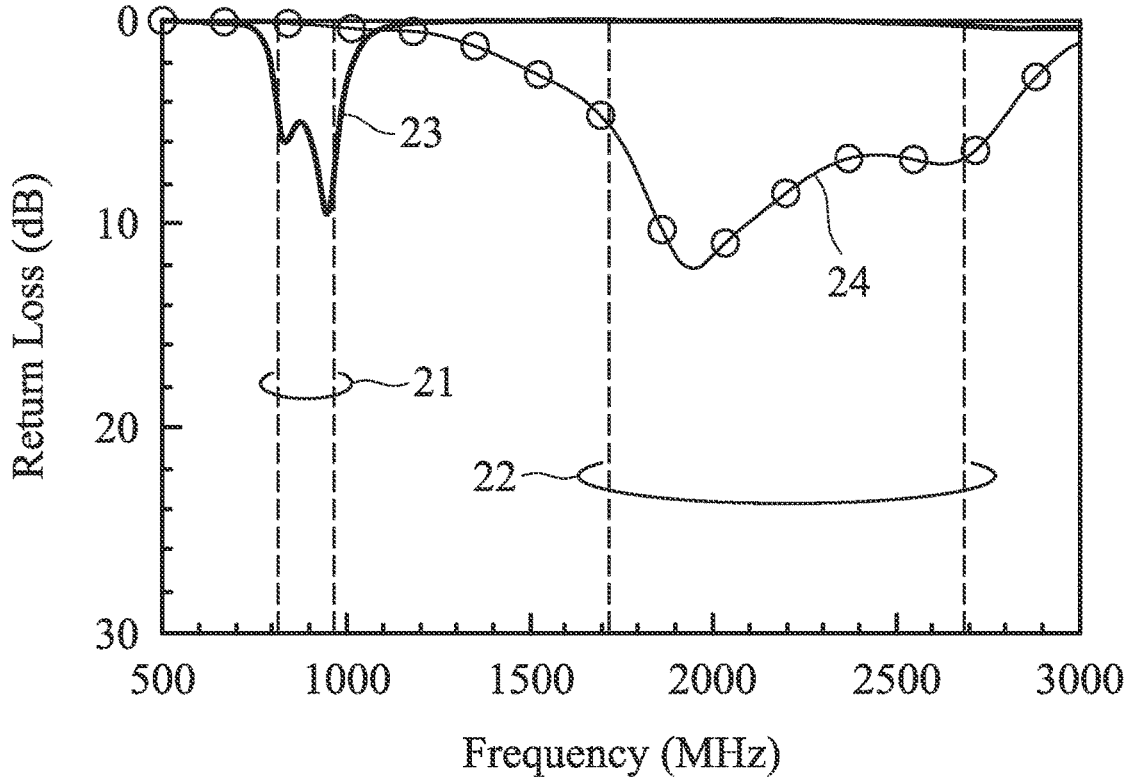
FIG. 2 is a diagram for illustrating return loss of an antenna element of a communication device according to a first embodiment of the invention.

FIG. 2 is a diagram for illustrating return loss of the antenna element 12 of the communication device 100 according to the first embodiment of the invention. In some embodiments, the sizes and parameters of the elements of the communication device 100 are as follows. The ground element 11 has a length of about 200 mm and a width of about 150 mm. The antenna element 12 has a length of about 60 mm and a width of about 7 mm. The antenna element 12 has a low-profile structure, and is formed on an FR4 (Flame Retardant 4) substrate having a thickness of 0.8 mm. The first metal element 13 of the antenna element 12 is excited to generate a first band 21 (referring to the return loss curve 23 of FIG. 2), and the second metal element 14 of the antenna element 12 is excited to generate a second band 22 (referring to the return loss curve 24 of FIG. 2). In a preferred embodiment, the first band 21 covers the GSM850/900 bands (approximately from 824 MHz to 960 MHz), and the second band 22 covers the GSM1800/1900/UMTS/LTE2300/2500 bands (approximately from 1710 MHz to 2690 MHz).

Figure 3:
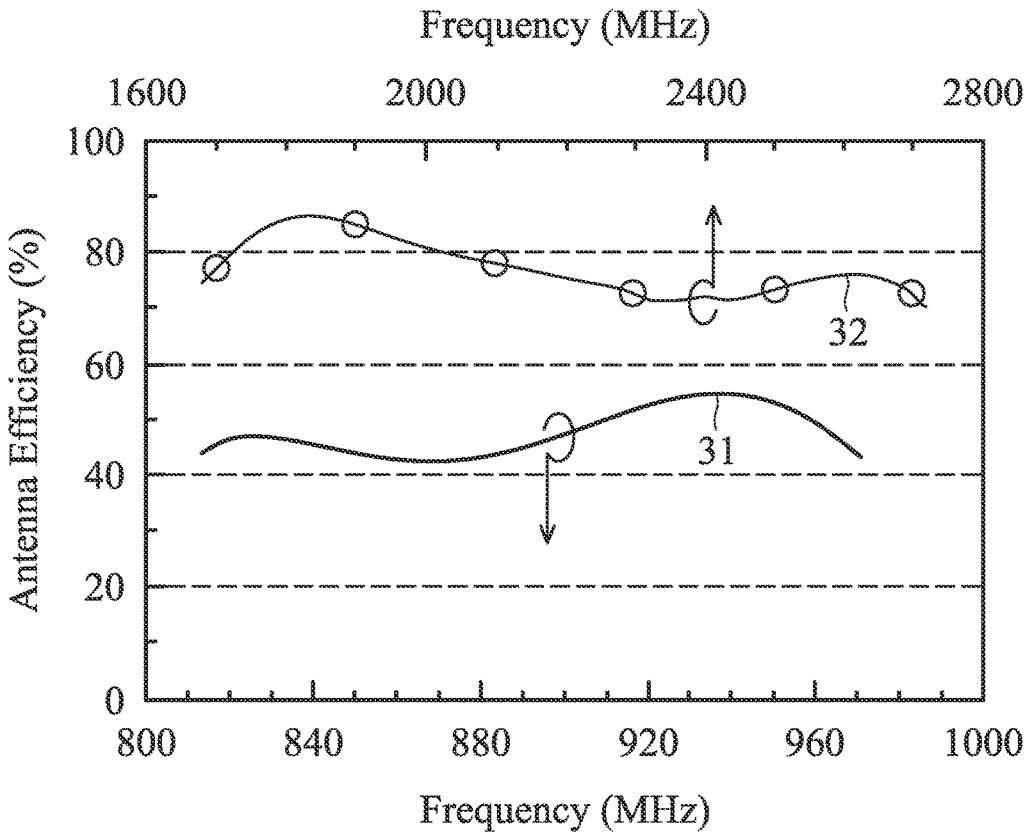
FIG. 3 is a diagram for illustrating antenna efficiency of an antenna element of a communication device according to a first embodiment of the invention.

FIG. 3 is a diagram for illustrating the antenna efficiency of the antenna element 12 of the communication device 100 according to the first embodiment of the invention. The antenna efficiency curve 31 represents the antenna efficiency (return losses included) of the antenna element 12 operating in the GSM850/900 bands (approximately from 824 MHz to 960 MHz). The antenna efficiency curve 32 represents the antenna efficiency (return losses included) of the antenna element 12 operating in the GSM1800/1900/UMTS/LTE2300/2500 bands (approximately from 1710 MHz to 2690 MHz). As shown in FIG. 3, the antenna efficiency of the antenna element 12 is approximately from 42% to 55% in the GSM850/900 bands, and the antenna efficiency of the antenna element 12 is approximately from 70% to 85% in the GSM1800/1900/UMTS/LTE2300/2500 bands. Thus, the antenna efficiency meets application requirements.

Figure 4:
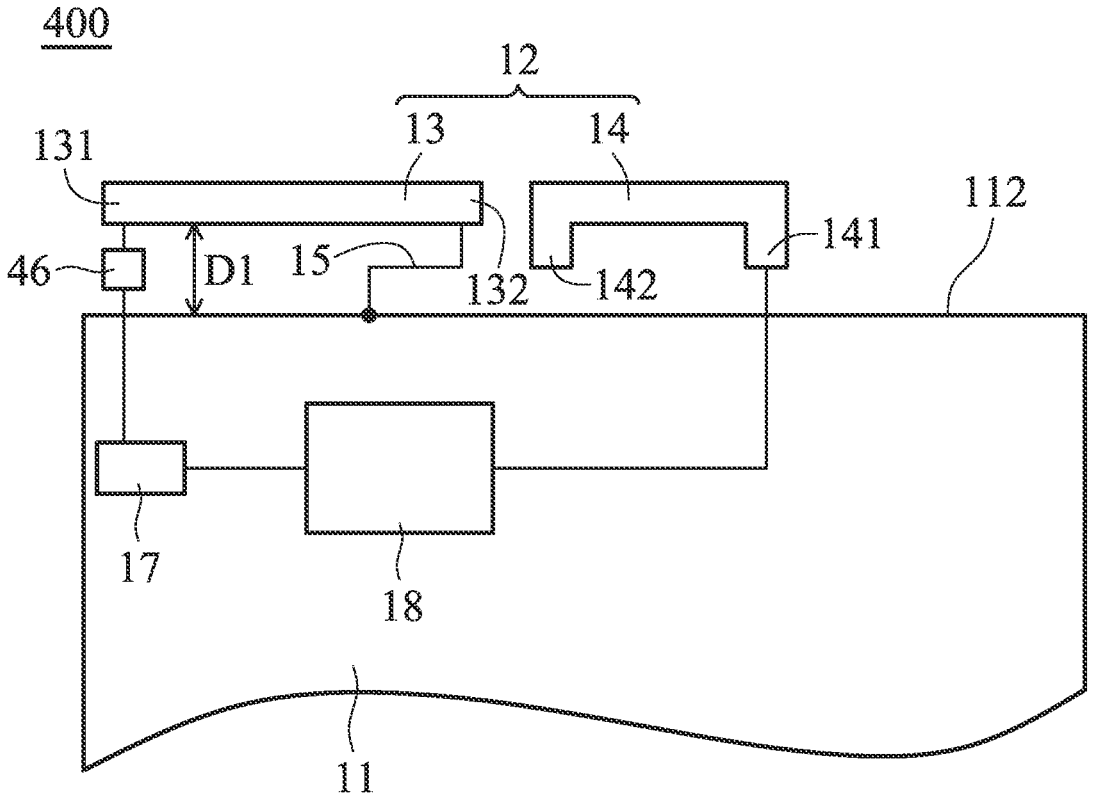
FIG. 4 is a diagram for illustrating a communication device according to a second embodiment of the invention.

FIG. 4 is a diagram for illustrating a communication device 400 according to a second embodiment of the invention. In the second embodiment, a capacitive element 46 of the communication device 400 is disposed in a clearance region of the first metal element 13. That is, the capacitive element 46 does not overlap with the ground element 11. The capacitive element 46 may be a distributed capacitor. Other features of the communication device 400 of the second embodiment are similar to those of the communication device 100 of the first embodiment. Accordingly, the two embodiments can achieve similar performances.

Figure 5:
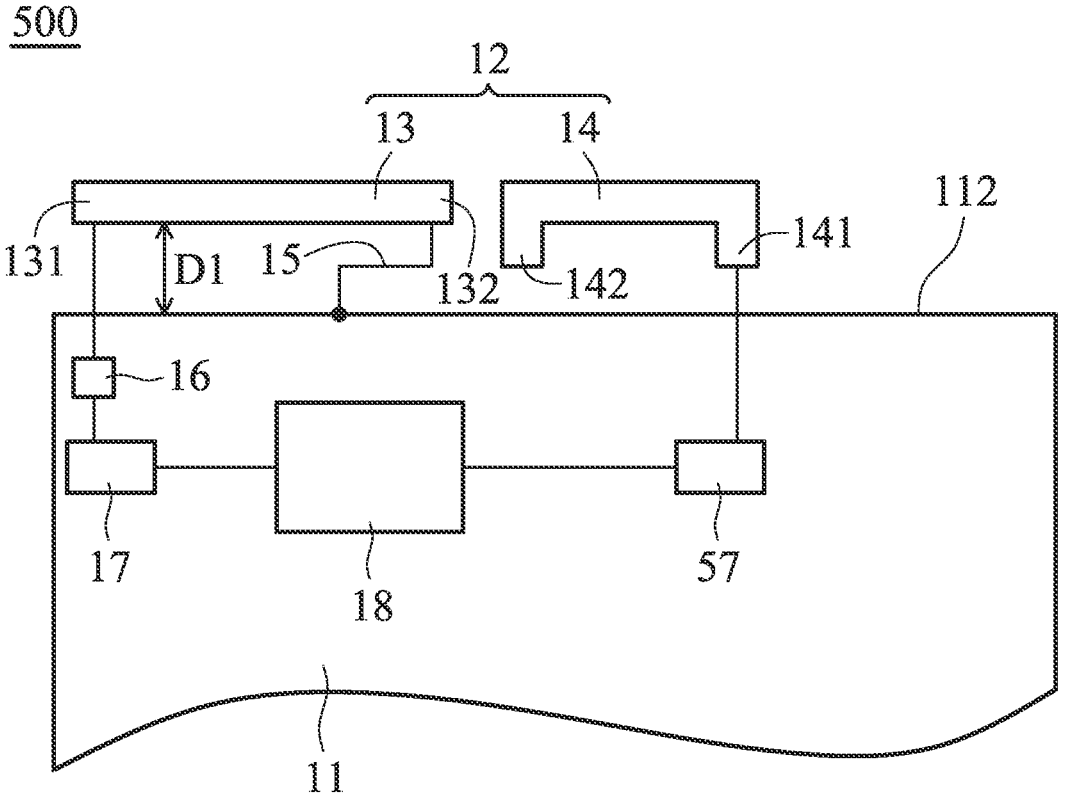
FIG. 5 is a diagram for illustrating a communication device according to a third embodiment of the invention.

FIG. 5 is a diagram for illustrating a communication device 500 according to a third embodiment of the invention. In the third embodiment, the communication device

500 further comprises a second matching circuit 57, and the third end 141 of the second metal element 14 is further coupled through the second matching circuit 57 to the communication module 18. The second matching circuit 57 provides a second impedance value, which may be different from the first impedance value of the first matching circuit 17. In some embodiments, the second matching circuit 57 comprises one or more inductors and capacitors, such as chip inductors and chip capacitors. The second matching circuit 57 can decrease the resonant length of the second metal element 14, thereby reducing the total size of the antenna element 12. Other features of the communication device 500 of the third embodiment are similar to those of the communication device 100 of the first embodiment. Accordingly, the two embodiments can achieve similar performances.

Note that the above element sizes, element shapes, and frequency ranges are not limitations of the invention. An antenna designer can change these setting values according to different requirements.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A communication device, comprising:

a ground element; and an antenna element, disposed adjacent to an edge of the ground element, wherein the antenna element comprises:

a first metal element, having a first end and a second end, wherein the first end is coupled through a capacitive element to a communication module, and the second end is coupled through a shorting element to the ground element; and a second metal element, having a third end and a fourth end, wherein the third end is directly connected to the communication module, and the fourth end is open, wherein the first metal element and the second metal element are adjacent to each other, but are not connected to each other, and wherein the first metal element overlies a first area of the edge of the ground element, the second metal element overlies a second area of the edge of the ground element, and the first area and the second area do not overlap with each other;

wherein a first matching circuit is further coupled between the capacitive element and the communication module;

wherein the capacitive element is a chip capacitor disposed in a clearance region of the first metal element, such that the chip capacitor does not overlap with the ground element.

2. The communication device as claimed in claim 1, wherein the first end and the third end are away from each other, and the second end and the fourth end are between the first end and the third end.

3. The communication device as claimed in claim 1, wherein a second matching circuit is further coupled between the third end and the communication module.

4. The communication device as claimed in claim 1, wherein the first metal element is excited to generate a first band, the second metal element is excited to generate a second band, and frequencies of the second band are higher than frequencies of the first band.

5. The communication device as claimed in claim 4, wherein the first band is approximately from 824 MHz to 960 MHz, and the second band is approximately from 1710 MHz to 2690 MHz.

6. The communication device as claimed in claim 1, wherein the first metal element substantially extends parallel to the edge of the ground element.

7. The communication device as claimed in claim 1, wherein the first metal element substantially has a straight-line shape.

8. The communication device as claimed in claim 1, wherein the second metal element substantially has an inverted U-shape.

9. The communication device as claimed in claim 1, wherein a length of the shorting element is greater than a distance between the first metal element and the edge of the ground element.

* * * * *